US006760555B2

(12) United States Patent
Dougherty et al.

(10) Patent No.: US 6,760,555 B2
(45) Date of Patent: Jul. 6, 2004

(54) SYSTEM FOR AND METHOD OF TONER FLOW CONTROL

(75) Inventors: Patrick S. Dougherty, Boise, ID (US); George Bernhard Clifton, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/103,451

(22) Filed: Mar. 21, 2002

(65) Prior Publication Data

US 2003/0180070 A1 Sep. 25, 2003

(51) Int. Cl.[7] ..... G03G 15/08
(52) U.S. Cl. ..... 399/103; 399/105
(58) Field of Search ..... 399/103, 105, 399/106, 102

(56) References Cited

U.S. PATENT DOCUMENTS 5,625,440 A * 4/1997 Matsumae et al. ..... 399/103
5,655,178 A * 8/1997 Ishikawa et al. ..... 399/103 X
5,697,021 A * 12/1997 Watanabe et al. ..... 399/103 X
5,701,558 A * 12/1997 Kojima ..... 399/103
5,757,395 A 5/1998 Chew et al. ..... 347/24
5,760,817 A 6/1998 Foote et al. ..... 347/248
5,790,923 A * 8/1998 Oguma et al. ..... 399/106
5,794,101 A * 8/1998 Watanabe et al. ..... 399/103
5,854,961 A 12/1998 Wibbels et al. ..... 399/281
6,266,500 B1 * 7/2001 Numagami et al. ..... 399/103
2001/0012459 A1 * 8/2001 Fujita et al. ..... 399/103
2001/0021318 A1 * 9/2001 Hashimoto et al. ..... 399/103
2002/0028086 A1 * 3/2002 Sato et al. ..... 399/103

FOREIGN PATENT DOCUMENTS

JP 359214864 * 12/1984 ..... G03G/15/08
JP 10143049 A * 5/1998 ..... G03G/15/08
JP 410143049 A * 5/1998 ..... G03G/15/08

* cited by examiner

*Primary Examiner*—Hoang Ngo

(57) ABSTRACT

The present invention is directed to a sealing mechanism for use in a toner cartridge. The sealing mechanism includes a developer roller and a toner plow. The developer roller has an outer cylindrical surface. The toner plow includes a concave contact region configured to mate with the outer cylindrical surface of the developer roller and a toner plow face placed at an acute angle with respect to a longitudinal axis of the developer roller.

14 Claims, 4 Drawing Sheets

SYSTEM FOR AND METHOD OF TONER FLOW CONTROL

RELATED APPLICATIONS

The present application is related to commonly assigned U.S. patent application Ser. No. 10/103,209 entitled "A SYSTEM FOR AND METHOD OF REDUCING TONER SEAL LEAKAGE BY THE INTRODUCTION OF A STEP GROOVE IN THE DEVELOPER ROLLER" filed concurrently; U.S. patent application Ser. No. 10/103,430 entitled "SYSTEM FOR AND METHOD OF PREVENTING TONER LEAKAGE PAST DEVELOPER SEALS USING STATIC CHARGE" filed concurrently; U.S. patent application Ser. No. 10/103,371 entitled "SYSTEM FOR AND METHOD OF REDUCING OR ELIMINATING TONER LEAKAGE WITH A VIBRATING SEAL" filed concurrently; and U.S. patent application Ser. No. 10/103,208 entitled "METHOD OF AND SYSTEM FOR THE REDUCTION OF TONER PRESSURE APPLIED TO A PRINT SEAL THROUGH THE IMPLEMENTATION OF A TAPERING CHANNEL" filed concurrently, the disclosures of which are hereby incorporated herein by reference in their entirety.

TECHNICAL FIELD

The present invention generally relates to electrophotographic printing devices and more specifically to the reduction or elimination of toner leakage through seals that are used in printer toner cartridges.

BACKGROUND

Currently there are several types of technologies used in printing and copying systems. Electrophotographic printing devices, such as laser printers and copiers, use toner particles to form the desired image on the print medium, which is usually some type of paper. Once the toner is applied to the paper, the paper is advanced along the paper path to a fuser. In many printers, copiers and other electrophotographic printing devices, the fuser includes a heated fusing roller engaged by a mating pressure roller. As the paper passes between the rollers, toner is fused to the paper through a process of heat and pressure.

FIG. 1 is a diagram of typical laser printing device 100 employing an Electro Photography (EP) process. Laser printing device 100 employs a removable toner cartridge 118 configured to supply toner particles to an integral Organic Photo Conductor (OPC) drum 109 which applies a developed toner image to a receiving media, e.g., a sheet of paper. For monochromatic printing, a single color of toner particles 101 (e.g., black) is held in toner supply hopper 102. Toner particles 101 are typically small plastic (e.g., styrene) particles on the order of 5 microns ($10^{-6}$ meters) in size. Agitator (or stirring blade) 103 is typically made of plastic, such as mylar, and ensures that toner particles 101 are uniformly positioned along developer roller 104 while inducing a negative charge onto the toner particles in the range of −30 to −80 micro-coulomb per gram ($\mu$c/g). Developer roller 104 rotates in a counterclockwise direction about a shaft. Stationary magnet 105, internal to the developer roller assembly, attracts toner particles 101 to rotating developer roller 104 under influence of magnetic forces produced by stationary magnet 105. Doctor blade 106 charges the toner and metes out a precise and uniform amount of toner particles 101 onto developer roller 104 as its outer surface rotates external to toner supply hopper 102. As the outer surface of developer roller 104 rotates back into toner supply hopper 102 developer sealing blade 107 removes any excess toner particles 101 that are affixed to developer roller 104 because they did not transfer to OPC drum 109.

Primary Charging Roller (PCR) 108 conditions OPC drum 109 using a constant flow of current to produce a blanket of uniform negative charge on the surface of OPC drum 109 in the vicinity of PCR 108. Production of the uniform charge by PCR 108 also has the effect of erasing residual charges left from any previous printing or transfer cycle.

A critical component of the EP process is OPC drum 109. In a preferred embodiment, OPC drum 109 is a thin-walled aluminum cylinder coated with a photoconductive layer. The photoconductive layer may constitute a photodiode that accepts and holds a charge from PCR 108. Initially, the unexposed surface potential of OPC drum 109 is charged to approximately −600 volts by PCR 108. Typically, the photoconductive layer comprises three layers including, from the outermost inward, a Charge Transport Layer (CTL), Charge Generation Layer (CGL), and barrier or oxidizing layer formed on the underlying aluminum substrate. The CTL is a clear layer approximately 20 microns thick, which allows light to pass through to the CGL and controls charge acceptance to the OPC. The CGL is about 0.1 to 1 micron thick and allows the flow of ions. The barrier layer bonds the photoconductive layer to the underlying aluminum substrate.

Scanning laser beam 110 exposes OPC drum 109 one line at a time at the precise locations that are to receive toner (i.e., the paper locations that correspond to dark areas of the image being printed). OPC drum 109 is discharged from −600 V to approximately −100 V at points of exposure to laser beam 110, creating a relatively positively charged latent image on its surface. Transformation of the latent image into a developed image begins when toner particles 101 are magnetically attracted to rotating developer roller 104. Alternatively, if a nonmagnetic toner is used, developer roller 104 may comprise a developer roller to mechanically capture and transport toner particles 101. In this case, an open cell foam roller may be included to apply toner to developer roller 104. The still negatively charged toner particles held by developer roller 104 are attracted to the relatively positively charged areas of the surface of OPC drum 109 and "jump" across a small gap to the relatively positively charged latent image on OPC drum 109 creating a "developed" image on the drum.

Blank paper to receive toner from OPC drum 109 is transported along paper path 111 between OPC drum 109 and transfer roller 112, with the developed image transferred from the surface of OPC drum 109 to the paper. The transfer occurs by action of transfer roller 112 which applies a positive charge to the underside of the paper, attracting the negatively-charged toner particles and causing them to move onto the paper. Wiper blade 113 cleans the surface of OPC drum 109 by scraping off the waste (untransferred) toner into waste hopper 115, while recovery blade 114 prevents the waste toner from falling back onto the paper. Fusing occurs as the paper, including toner particles, is passed through a nip region between heated roller 116 and pressure roller 117 where the toner is melted and fused (or "bonded") to the paper. Heated roller 116 and pressure roller 117 are together referred to as the fuser assembly.

One design consideration with EP imaging devices, such as laser printers, is to minimize the leakage of toner from hopper 102. Leakage sometimes occurs at the ends of developer roller 104. Several methodologies and arrangements have been used to reduce or eliminate toner leakage from the ends of developer roller 104. Some printers employ a foam or felt mechanical seal at the ends of developer roller 104 as a physical barrier to prevent toner particles from slipping past the interface between developer roller 104 and toner supply hopper 102. Alternatively, when the toner includes magnetic properties, such as in many black and white printers, magnetic seals may be provided at the ends of developer roller 104 to attract monochromatic toner particles and create a physical barrier, consisting of the monochromatic toner particles, to prevent additional particles from leaking. Such techniques are generally inapplicable to the non-magnetic type of toner used, for example, in most color printers and copiers.

FIGS. 2 and 3 show other embodiments of a prior art developer roller/seal combinations. Support 202 positions seal 201 to ride on the surface portion of developer roller 204 within toner supply hopper 102 to limit toner migration past the seal and out of the hopper. In this arrangement, developer roller 204 interfaces directly with seal 201 in the area of reference point 302 and 303 (FIG. 3). Toner particles 101 are also present in the area of reference points 302 and 303, and the toner particles tend to build up in these areas adjacent seal 201. As developer roller 204 rotates in the direction indicated by arrow 304 (i.e., clockwise as viewed from the left end of developer roller 204), toner particles become lodged between developer roller 204 and seal 201. Toner particles 101 are pushed in a direction indicated by arrow 203. As developer roller 204 continues to rotate and additional toner particles become wedged in this interface, toner particles leak through seal 201. Seal leakage introduces toner into critical areas of the mechanism, thereby degrading performance, increasing maintenance requirements, and producing undesirable artifacts on the resultant printed paper or other product.

Accordingly, a need exists for a structure and method for reducing toner leakage in a toner cartridge.

SUMMARY OF THE INVENTION

The present invention is directed to a sealing mechanism for use in a toner cartridge comprising a developer roller having an outer cylindrical surface and a first plow including a concave contact region configured to mate with the outer cylindrical surface of the developer roller and a toner plow face placed at an acute angle with respect to a longitudinal axis of the developer roller.

Another embodiment of the present invention is directed to a method of reducing toner leakage in a toner cartridge comprising the steps of positioning a plow on an outer surface of a developer roller, rotating the developer roller and applying toner to the developer roller in a vicinity of the plow. In this embodiment, the plow pushes the toner in a direction away from an adjacent end of the roller, towards the middle of the roller.

Another embodiment of the present invention is directed to a toner cartridge comprising a housing, a development unit including a toner supply hopper and a developer roller having a cylindrical exterior surface. Also included in this embodiment is a cleaning unit including a waste hopper, a wiper blade, a cleaning blade and a blowout blade.

This latter embodiment also includes a primary charge roller, a transfer roller, an organic photo conductor and a pair of toner plows. The toner plows are integral to the housing, wherein each of the toner plows includes (i) a concave contact region configured to mate with the outer cylindrical surface of the developer roller and (ii) a toner plow face placed at an acute angle with respect to a longitudinal axis of the developer roller.

DETAILED DESCRIPTION

Figure 1:
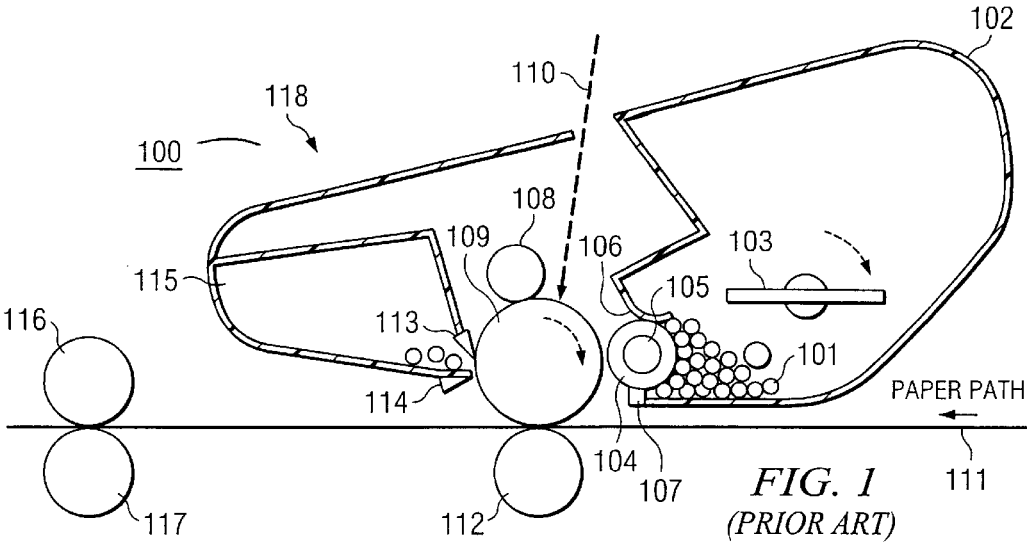
FIG. 1 (PRIOR ART)
FIG. 1 is a cross-section of a simplified electrophotographic printing device.
Figure 2:
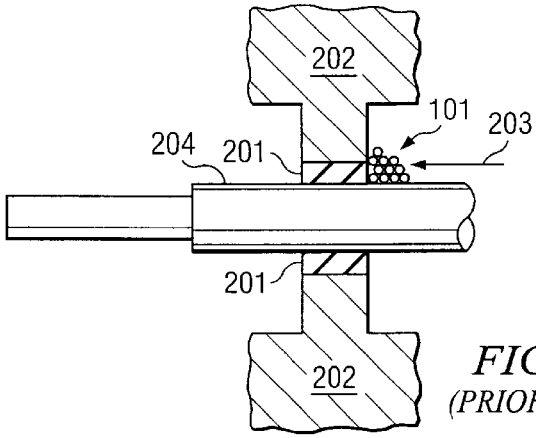
FIG. 2 (PRIOR ART)
FIG. 2 is a cross-section view of a prior art developer roller, seal and support of an electrophotographic toner cartridge.
Figure 3:
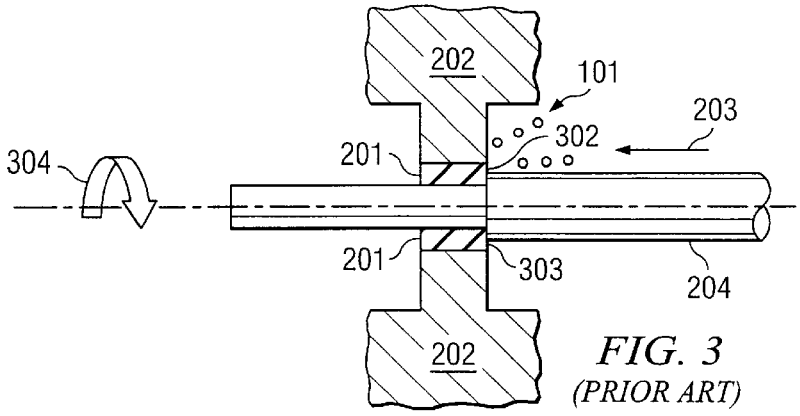
FIG. 3 (PRIOR ART)
FIG. 3 is a cross-section view of a prior art developer roller, seal and support.
Figure 4:
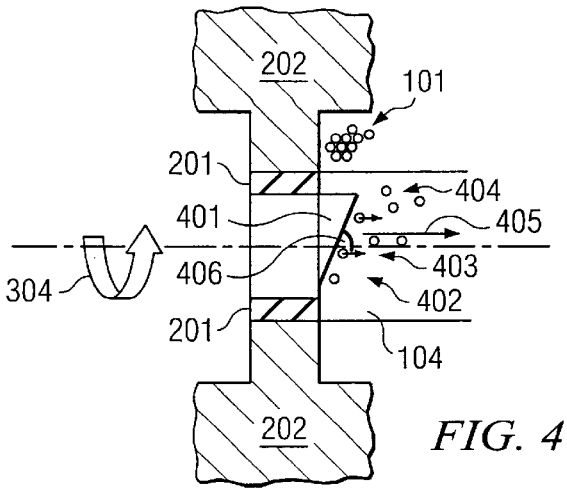
FIG. 4 is a cross-section view of a developer roller seal configuration according to an embodiment of the present invention.

FIG. 4 is a cross-section view of an embodiment of the present invention that is particularly well suited for retrofit installation in an existing toner cartridge design. In particular, the present embodiment mounts a plow member on the cartridge structure using the supply roller shaft hole to locate the position of the plow. A plow portion extends radially outward to engage an outer surface of an opposing developer roller. Though located by the shaft hole of the supply roller and solidly fixed to the cartridge, the plow is configured to direct toner away from the end of the opposing developer roller. In a preferred embodiment a plow would be located near each end of the developer roller. Note that other methods and means of mounting the plows in operative cooperation with the developer roller or other rollers may be provided.

Plow 401 may include a concave contact region configured to mate with the outer cylindrical surface of developer roller 104. Plow 401 may also include a toner plow face that is placed at acute angle 406 with respect to the longitudinal axis of developer roller 104. As the developer roller 104 rotates in the direction of arrow 304, toner particles 101 contact the toner plow face and are propelled along in the direction of the plow face as indicated by arrow 405. Toner particles 402 coming into initial contact with the plow face are propelled, by the rotation of developer roller 104 to position 403 and finally to position 404, such that toner particles 101 move away from the interface between developer roller 104 and seal 201. Developer roller 104 may include a metal shaft covered by a soft rubber outer layer. Note that developer roller 104 and plow 401 may interact to create some deformation in the outer layer of developer roller 104 to enhance contact therebetween. Plow 401 is preferably made of a material such as plastic as currently contained in toner cartridges. Preferably, a plow would be located near each end of developer roller 104.

Plow 401 blocks the path of toner particles 101 from the interface between seal 201 and developer roller 104, and its shape forces toner particles away from seal 201. In the case of a developer roller with a non-deformable outer layer, the present invention may be implemented by use of an elastomeric plow, or a plow made of elastomeric material such as rubber. Note that a modulus of elasticity (E) is used to measure the hardness of various materials. For example, aluminum has a modulus of elasticity of approximately 73 $KN/mm^2$ and rubber has a modulus of elasticity of approximately 0.05 $KN/mm^2$. By selecting materials for developer roller 104 and plow 401 having substantially different orders of magnitude values of E of 1,000 or greater, deformation may be restricted to either developer roller 104 or plow 401.

The radius of curvature "R" of plow 401 may be compatible with (e.g., some or slightly smaller than) the outer radius of the developer roller to provide a good seal there between. Some deformation of the developer roller and/or seal may be used to enhance the contact region. For example, the plow may deform the developer roller at point of contact (i.e., encroach into the surface of the roller by between 1 and 3 thousandths of an inch). The plow face may have a pitch of between 15 and 35 degrees, preferably 25 degrees, dependent upon the size of the developer roller, its speed of rotation, the arc subtended by the plow over the surface of the developer roller, the diameter of the supply roller and other mechanical features and limitations.

Figure 5:
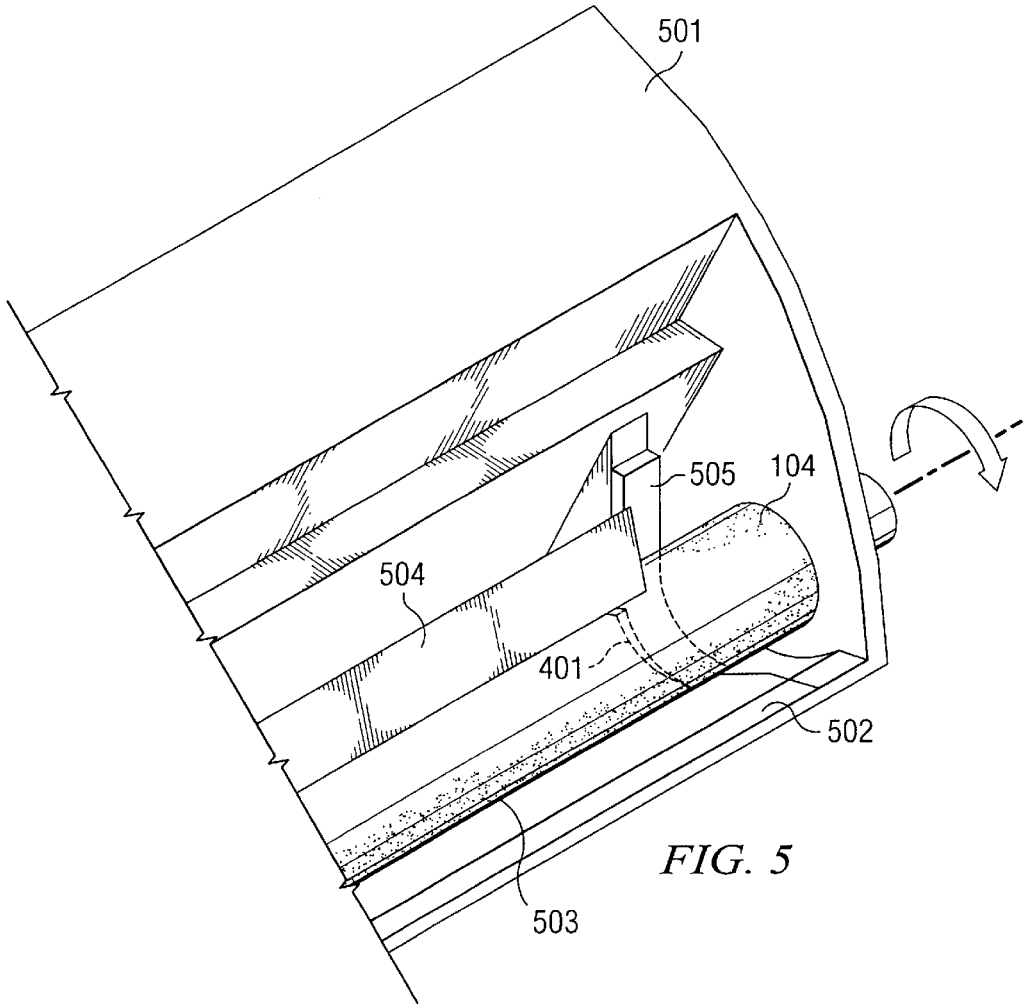
FIG. 5 is a perspective view of an end of a toner hopper portion of a toner cartridge incorporating a sealing mechanism according to the present invention.

FIG. 5 is a partial perspective view showing a toner cartridge implementing one embodiment of the current invention. Toner cartridge 501 includes developer roller 104, supply roller 503 (hidden behind developer roller 104), blow out seal 502, plow 401, doctor blade 504 and developer end (D-End) seal 505. Toner through supply roller 503 is applied to the outer surface of developer roller 104. As developer roller 104 rotates, toner particles (not shown) move towards seal 505. When toner particles reach plow 401 the rotation of developer roller 104 forces toner particles along the edge of the plow away from seal 505, thereby reducing toner fluid pressure on seal 505 and eliminating or reducing toner leakage through seal 201. Additionally, by diverting toner particles towards doctor blade 504, the toner particles are then used to form images on paper rather than being lost through seal 505.

Figure 6:
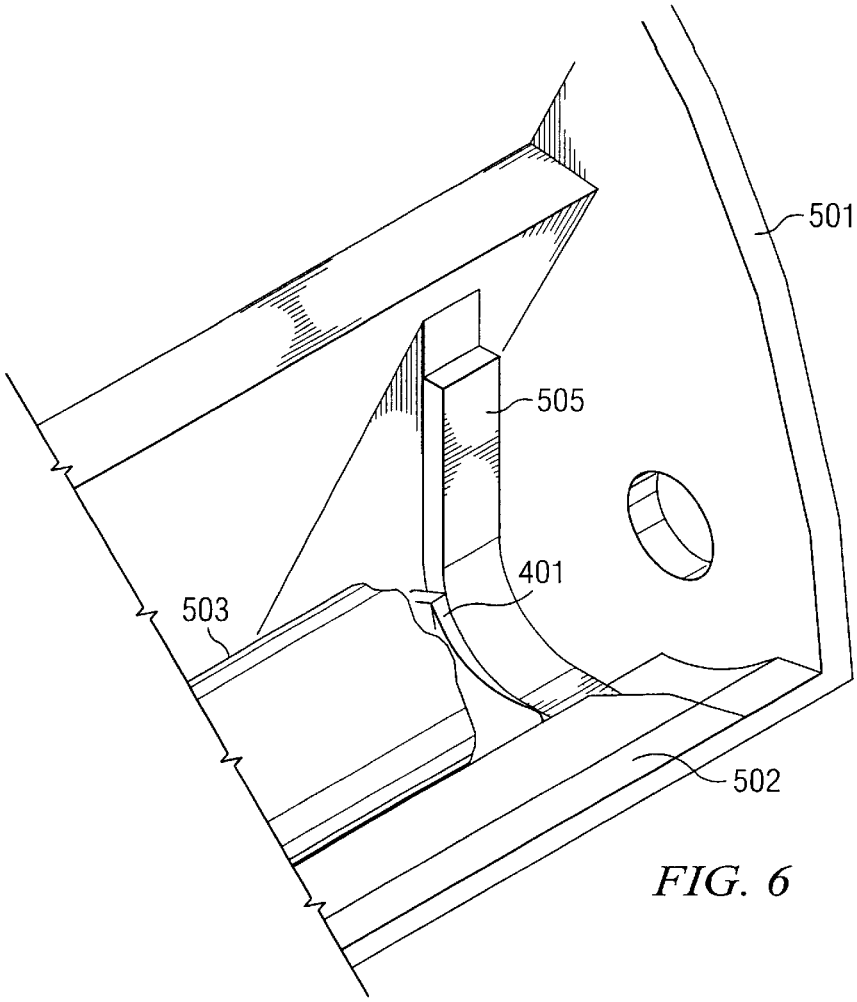
FIG. 6 is a magnified view of a developer roller and seal interface which incorporates the present invention.

FIG. 6 is an enlarged diagram of the arrangement of supply roller 503, plow 401 and seal 505 of toner cartridge 501 as visible with the developer roller removed. Note that seals used to inhibit toner fluid leaking past the end of supply roller 503 are typically located behind the roller and are therefore not visible in the current view. Similarly, plow 401 engages or rides along on the outer surface of the developer roller (not shown), directing toner particles away from D-end seal 505. D-end seal 505 is used to seal the end of the developer roller along a portion whereat toner is applied by supply roller 503. As toner particles on the surface of the developer roller move toward seal 505, they contact plow 401 and are pushed or propelled away from seal 505. Note that FIGS. 4, 5 and 6 show one position for a plow, and a second plow may be mounted near the other end of the developer rollers. In this instance, a mirror of FIGS. 4, 5 and 6 would show the corresponding plow pushing toner toward the center of the roller.

Figure 7:
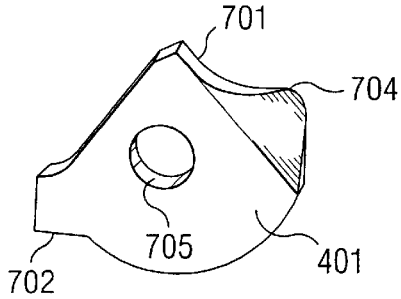
FIG. 7 is side perspective view of a retrofit ramp according to the present invention.

FIG. 7 is a side perspective view showing one embodiment of plow 401 for the present invention. In this embodiment plow 401 has a snow plow edge at 704. The radius of plow 401 at reference point 701 is preferably the same as the radius of the developer roller (for example 6–8 mm). The radius at reference point 704 is preferably 1–2 mm. The difference between radius 704 and radius 701 enables plow 401 to push toner particles away from seal 505. Plow 401 preferably is configured to interface with other portions of the toner cartridge to retain it stationary next to the supply roller. Reference point 702 shows one such mating surface engaging a fixed structure of the toner cartridge. Through hole 705 allows passage of an axle or central shaft of supply roller 503 through plow 401 to a suitable roller support formed in the toner cartridge (e.g., a hole in a sidewall of the toner cartridge housing) the configuration of FIG. 7 is particularly adapted to retrofitting into existing toner cartridge housings. However, the structure and, in particular, the plow-like configuration may be instead incorporated into the toner cartridge unit or housing as another portion of the injection molded body.

Figure 8:
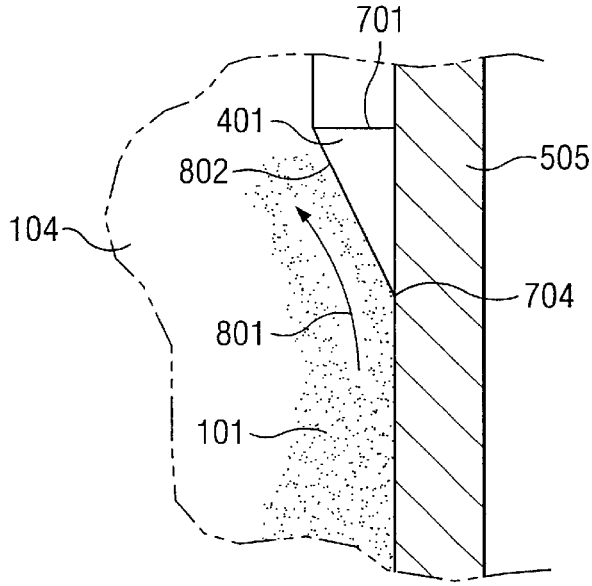
FIG. 8 is a top view of a developer roller and seal interface with a ramp according to the present invention in place.

FIG. 8 is a diagram of plow 401 mounted in its position in contact with the surface of developer roller 104 and abutting seal 505. As developer roller 104 rotates in the direction of arrow 801, toner particles 101 impact plow 401, and are moved along the toner plow face 802 and are moved away from seal 505.

Figure 9:
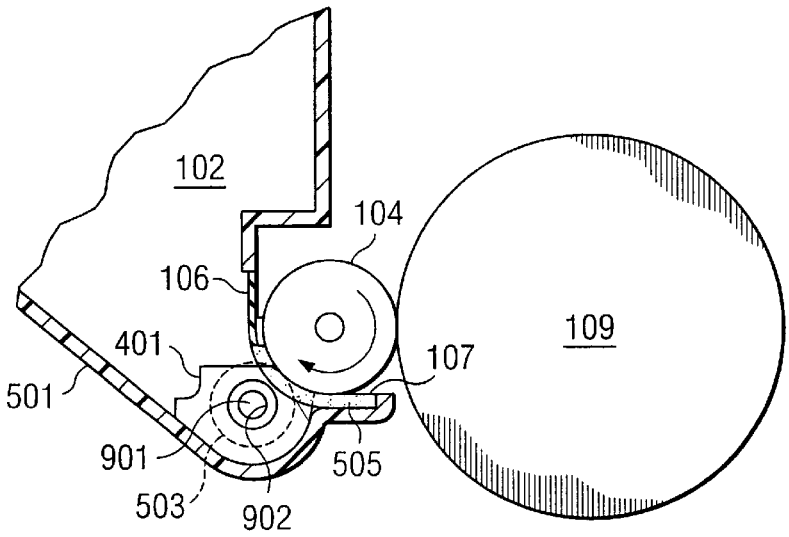
FIG. 9 is a side sectional view of a toner cartridge which incorporates a sealing system of the present invention.

FIG. 9 is a side sectional view of a portion of a toner cartridge 501 with one embodiment of plow 401 in place. Plow 401 is positioned between supply roller 503 and D-end seal 505. As developer roller 104 is rotated, toner particles impinge the toner plow face of plow 401 and are pushed away from D-end seal 505. Supply roller 503 includes a central shaft 901 passing through plow 401 to be supported by a hole 902 formed in a sidewall of toner supply hopper 102.

Although the present invention has been described in the context of a retrofitable component for plowing toner along the surface of a developer roller, it is equally applicable to alternative constructions and uses including, for example, to redirect other fluids away from seals used on other roller structure.

What is claimed is:

1. A sealing mechanism for use in a toner cartridge, comprising a developer roller having an outer cylindrical surface;

a first plow including a concave contact region configured to mate with said outer cylindrical surface of said developer roller and a toner plow face placed at an acute angle with respect to a longitudinal axis of said developer roller;

a supply roller wherein said supply roller provides toner to said developer roller; and a support for said supply roller, said first plow having a mounting hole engaging said support for said supply roller.

2. The sealing mechanism of claim 1 wherein said first plow is proximate to a first end of said developer roller.

3. The sealing mechanism of claim 1 further comprising a second plow including a concave contact region configured to mate with said outer cylindrical surface of said developer roller and a toner plow face placed at an acute angle with respect to the longitudinal axis of said developer roller, wherein said second plow is proximate to a second end of said developer roller.

4. The sealing mechanism of claim 1 wherein said first plow is composed of a material selected from the group consisting of:

nylon, polystyrene and polycarbonate.

5. The sealing mechanism of claim 1 wherein said first plow encroaches into said developer roller a distance of 1 to 3 thousands of an inch.

6. The sealing mechanism of claim 1 wherein said contact region inwardly deforms said outer surface of said developer roller by between 0 and 3 thousands of an inch.

7. The sealing mechanism of claim 1 wherein a leading edge of said plow has a radius of between 1 and 3 thousands of an inch.

8. A method of reducing toner leakage in a toner cartridge comprising:

positioning a plow on an outer surface of a developer roller, wherein said plow includes a concave contact region configured to mate with a cylindrical surface of said developer roller and a toner plow face placed at an acute angle with respect to a longitudinal axis of said developer roller;

rotating a supply roller wherein said supply roller provides toner to said developer roll, wherein said supply roller is supported by a support structure, and wherein said plow has a mounting hole engaging said support structure;

rotating said developer roller; and applying toner to said developer roller in a vicinity of said plow;

whereby said plow pushes said toner longitudinally along said developer roller in a direction away from said plow.

9. The method of claim 8, further comprising:

locating said plow proximate to the one end of said developer roller.

10. The method of claim 8, further comprising:

positioning a second plow on an outer surface of said developer roller;

whereby said second plow pushes said toner along an outer surface of said developer roller in a direction toward a center of said developer roller.

11. The method of claim 8, further comprising:

forming said plow from a material selected from the group consisting of:

nylon, polystyrene and polycarbonate.

12. A toner cartridge, comprising:

a housing;

a development unit including a toner supply hopper and a developer roller having a cylindrical exterior surface;

a cleaning unit including a waste hopper, a wiper blade, a cleaning blade and a blow-out blade;

a primary charge roller;

a transfer roller;

an organic photo conductor; and a pair of toner plows integral with said housing, each of said toner plows including a concave contact region configured to mate with said outer cylindrical surface of said developer roller and a toner plow face placed at an acute angle with respect to a longitudinal axis of said developer roller;

wherein said outer cylindrical surface of said developer roller has a modulus of elasticity substantially different from a modulus of elasticity of said toner plows;

wherein one of (i) said modulus of elasticity of said developer roller and (ii) said modulus of elasticity of said toner plows is greater than 50 $KN/mm^2$ and the other is less than 0.1 $KN/mm^2$.

13. The toner cartridge of claim 12 wherein said toner plows are made of a relatively hard material in comparison with said outer cylindrical surface of said developer roller whereby said toner plows cause a deformation of said outer cylindrical surface at a point of contact therewith.

14. The toner cartridge of claim 12 wherein said toner plows are of a relatively soft material in comparison with said outer cylindrical surface of said developer roller whereby said outer surface of said developer roller causes a deformation of said toner plows at a point of contact therewith.

* * * * *